US007127747B2

(12) United States Patent
Darnell et al.

(10) Patent No.: US 7,127,747 B2
(45) Date of Patent: Oct. 31, 2006

(54) PROTECTIVE EYEWEAR DEVICE FOR SPORTS

(75) Inventors: Eric Darnell, S. Strafford, VT (US); Jonathan Baker, Thornton, NH (US); William H. Brine, Hopkinton, MA (US); Timothy Ellsworth, Liverpool, NY (US); Stephen D. Moore, Liverpool, NY (US); Joel Robinson, Liverpool, NY (US)

(73) Assignee: Sport Helmets, Inc., Liverpool, NY (US)

( * ) Notice: Subject to any disclaimer, the term of this patent is extended or adjusted under 35 U.S.C. 154(b) by 8 days.

(21) Appl. No.: 10/340,395

(22) Filed: Jan. 10, 2003

(65) Prior Publication Data

US 2004/0133958 A1 Jul. 15, 2004

(51) Int. Cl.
*A61F 9/02* (2006.01)

(52) U.S. Cl. ..... 2/426; 2/9; 2/425

(58) Field of Classification Search ..... 2/9, 2/425, 426, 10, 424, 15, 43; 473/210, 422
See application file for complete search history.

(56) References Cited

U.S. PATENT DOCUMENTS

| | | | | | |
|---|---|---|---|---|---|
| 924,613 | A | * | 6/1909 | Hellawell | 2/9 |
| 1,186,442 | A | * | 6/1916 | Schaefer | 2/9 |
| 2,715,222 | A | | 8/1955 | Sowle | |
| 4,173,795 | A | * | 11/1979 | Lundin et al. | 2/425 |
| 4,229,837 | A | | 10/1980 | Solari | |
| 4,279,038 | A | * | 7/1981 | Bruckner et al. | 2/425 |
| 4,333,179 | A | * | 6/1982 | Laurita | 2/468 |
| 4,736,466 | A | * | 4/1988 | Kallstrom | 2/9 |
| 4,797,956 | A | | 1/1989 | Boyce | |
| 5,148,550 | A | | 9/1992 | Hodgkinson et al. | |
| 5,249,347 | A | * | 10/1993 | Martinitz | 29/460 |
| 5,267,353 | A | * | 12/1993 | Milligan | 2/9 |
| 5,394,564 | A | | 3/1995 | Rodriguez | |
| 5,911,308 | A | | 6/1999 | Chafitz et al. | |
| 6,012,164 | A | | 1/2000 | Deal, III | |
| 6,598,234 | B1 | * | 7/2003 | Brown et al. | 2/9 |

* cited by examiner

*Primary Examiner*—Katherine M. Moran
(74) *Attorney, Agent, or Firm*—Alan G. Towner, Esq.; Pietragallo, Bosick & Gordon LLP

(57) ABSTRACT

A protective eye mask for sports use, without a helmet, includes one or more substantially horizontal frame members forming an eye mask frame, defining a cage to protect an area around a user's eyes, the eye mask frame having at least an upper frame segment and a lower frame segment, the frame members having an inside facing towards the user's eyes and an outside facing away therefrom; one or more substantially horizontal frame members arranged between the upper and lower frame segments; one or more substantially vertical frame members continuous with or rigidly attached to one or more of the substantially horizontal frame members; a contact material for contacting the user's face area, attached to the eyewear frame; and a mechanism for securing the protective eye mask to the user's face.

28 Claims, 11 Drawing Sheets

PROTECTIVE EYEWEAR DEVICE FOR SPORTS

BACKGROUND OF THE INVENTION

1. Field of the Invention

The invention pertains to the field of sports equipment. More particularly, the invention pertains to a protective eyewear device designed primarily for the sports of field hockey and women's lacrosse.

2. Description of Related Art

The game of lacrosse is considered as the oldest team contact sport of North American origin. Historical evidence suggests that the game of lacrosse was played by various Indian tribes, such as the Iroquois and Hurons, as early in time as the 15th century. It generally is accepted that the original purpose of the sport of lacrosse was to physically and/or psychologically condition Indian warriors preparatory to actual combat or, in some instances, to itself function as a game forum for the settlement of tribal differences.

Because lacrosse is a rough contact sport, the potential for serious injuries is high and injuries are not uncommon, thus protective equipment is needed. More particularly, players can be injured by bodily contact with one another, and from stick checking (wherein a player uses the lacrosse stick to strike another player's stick) or other incidental contact with the lacrosse stick. Further, the modern lacrosse ball is made of a relatively dense rubber or rubber-like synthetic material, weighing approximately 140–150 grams and traveling at high speeds during play, thus, contact with the ball also can cause injuries. Therefore, a variety of protective equipment is used to avoid injuries. Such equipment includes, for example, protective gloves, various configurations of arm pads and shoulder pads, and modern helmets, which normally include a full face guard element. Also, the goalkeeper usually wears additional protective equipment, such as knee and shin guards and torso padding. Even with the use of such protective gear, injuries still are not uncommon in lacrosse, due to the aggressive nature of the sport.

Since the inception of the sport, lacrosse has evolved to become a popular team sport at high schools and colleges across the United States, and many modern schools now have both women's and men's lacrosse teams. Generally, different rules apply to men's and women's lacrosse leagues, and the protective equipment commonly used by male and female lacrosse players often differs. For example, generally, less physical contact is allowed in women's lacrosse, and therefore helmets with full face guards usually are not required. Instead, women's lacrosse employs a protective eyewear device to help avoid injuries, should an incidental contact occur in the area of the eyes.

The most common type of protective eyewear used in women's lacrosse is a pair of goggles, typically made from a polycarbonate material. Indeed, many women's lacrosse leagues require such eyewear by regulation. However, the protective eyewear of the prior art has numerous problems. For example, it is prone to glaring in the sun and fogging, particularly in cold, wet or humid weather. Further, it impedes players' vision, particularly the peripheral vision and the inferior or downward view (contributing to neck strain), and it can become scratched or marred, thereby further impairing players' vision. Furthermore, it can crack, craze or become brittle, and is susceptible to shattering upon impact, creating its own hazards. Moreover, the most common protective eyewear of the prior art does not provide ample protection against the potential impact of a lacrosse ball traveling at high-speed during play, because it is so rigid that it passes the full force of impact onto the user's face. Thus, there is a need for an improved protective eyewear device for sports use, particularly women's lacrosse.

SUMMARY OF THE INVENTION

Briefly stated, a protective eye mask for sports use, without a helmet, includes one or more substantially horizontal frame members forming an eye mask frame, defining a cage to protect an area around a user's eyes, the eye mask frame having at least an upper frame segment and a lower frame segment, the frame members having an inside facing towards the user's eyes and an outside facing away therefrom; one or more substantially horizontal frame members arranged between the upper and lower frame segments; one or more substantially vertical frame members continuous with or rigidly attached to one or more of the substantially horizontal frame members; a contact material for contacting the user's face area, attached to the eyewear frame; and a mechanism for securing the protective eye mask to the user's face. In the preferred embodiment, the protective eyewear device meets or exceeds the ASTM standard for women's adult and youth lacrosse (ASTM standard F803-01), and can absorb and dissipate a standard lacrosse ball impact of at least sixty miles per hour.

In an embodiment, the eye mask covers at least a user's inferior forehead, eyes and nasal bone, resting on the user's zygomatic arch, the eye mask having one or more substantially horizontal frame members forming an eye mask frame, defining a cage to protect an area around the user's eyes, the eye mask frame having at least an upper frame segment and a lower frame segment, the frame members having an inside facing towards the user's eyes and an outside facing away therefrom; one or more substantially horizontal frame members arranged between the upper and lower frame segments; one or more substantially vertical frame members continuous with or rigidly attached to one or more of the substantially horizontal frame members, wherein the substantially vertical members are arranged on the outside of the substantially horizontal members; a contact material for contacting the user's face area, attached to the eyewear frame; and means for securing the protective eyewear device to the user's face.

DETAILED DESCRIPTION OF THE INVENTION

Figure 1:
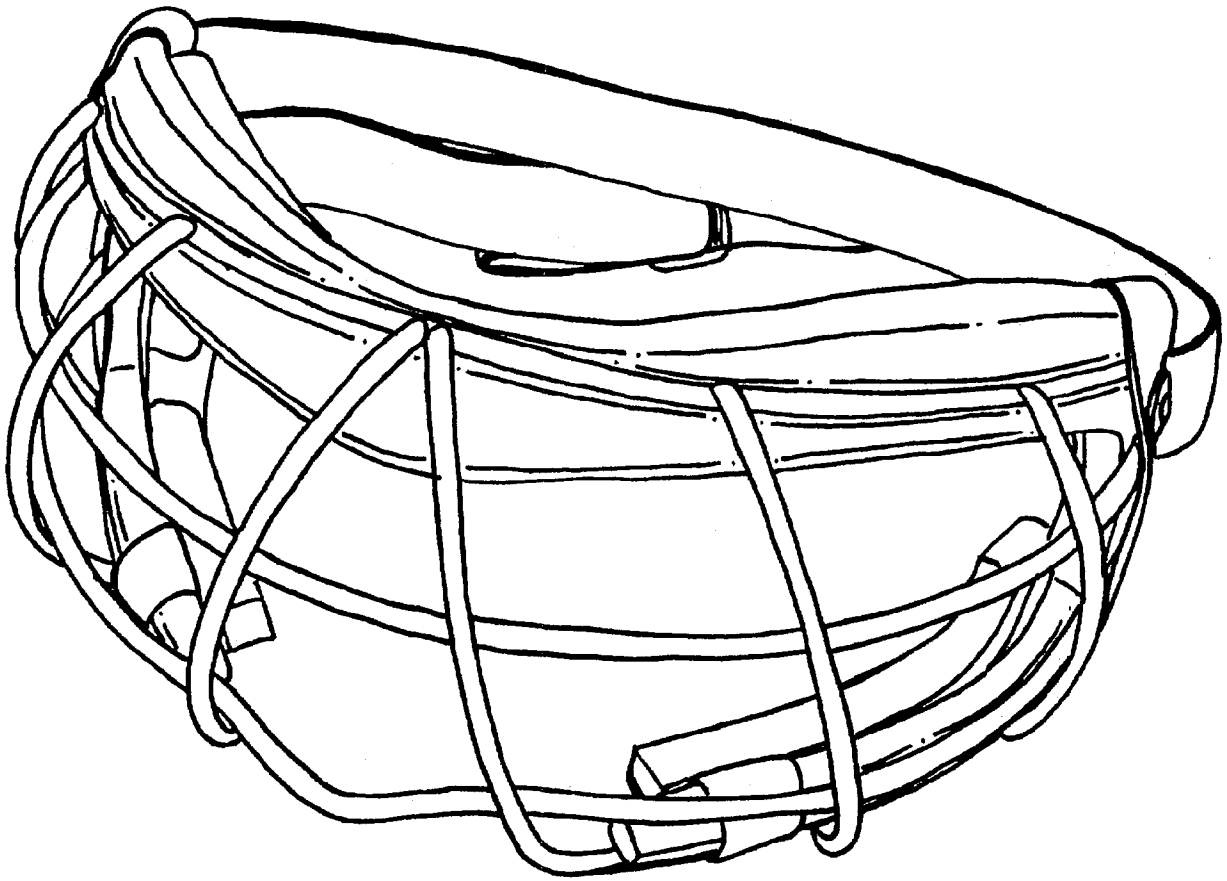
FIG. 1 shows an angle view of an embodiment of the protective eyewear device of the present invention.
Figure 2:
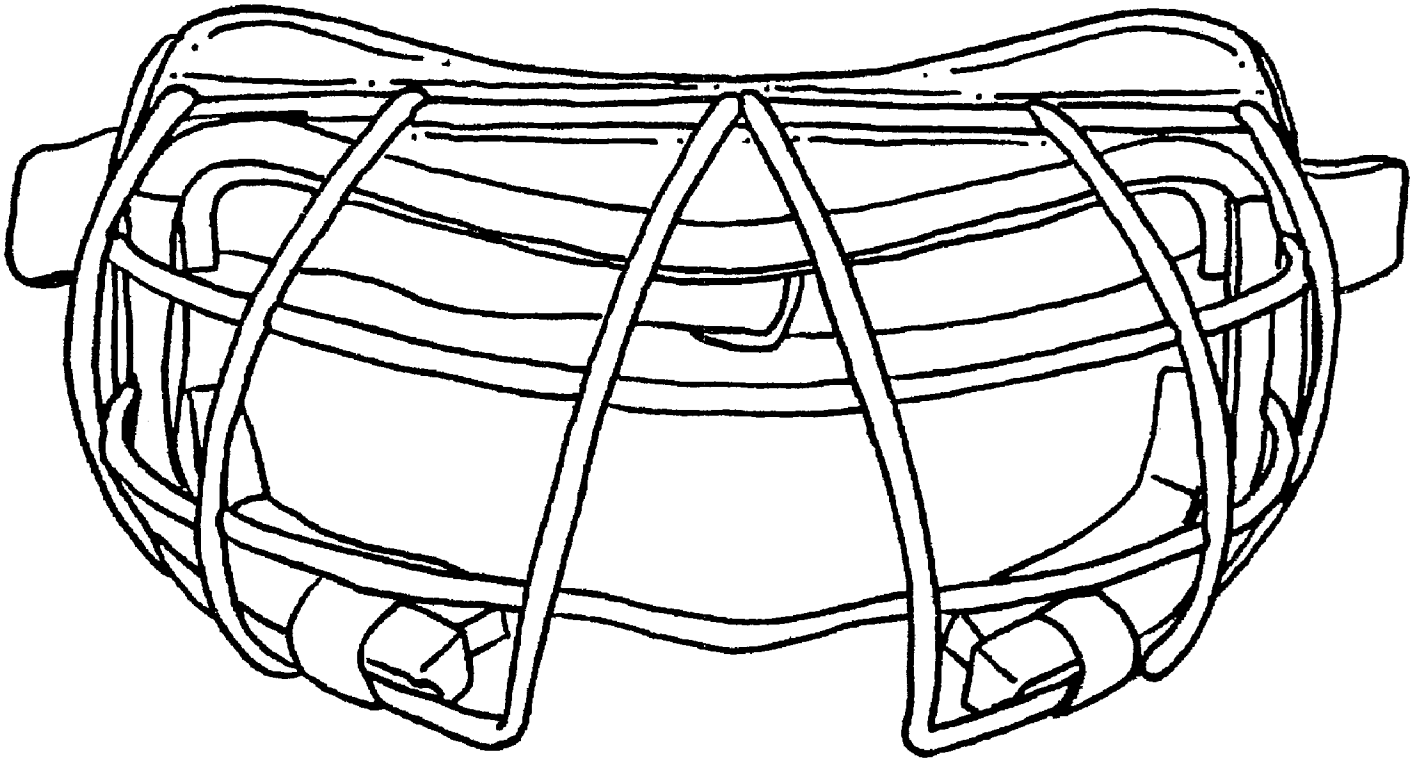
FIG. 2 shows a front view of the embodiment of FIG. 1.
Figure 3:
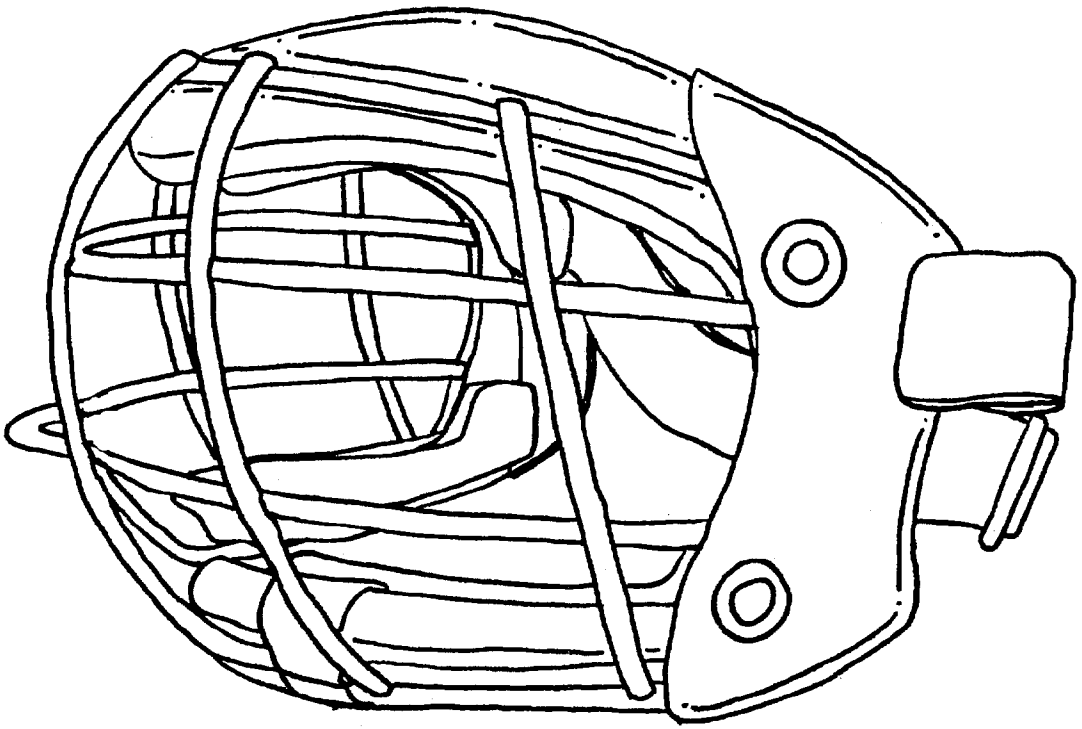
FIG. 3 shows a side view of the embodiment of FIG. 1.
Figure 4:
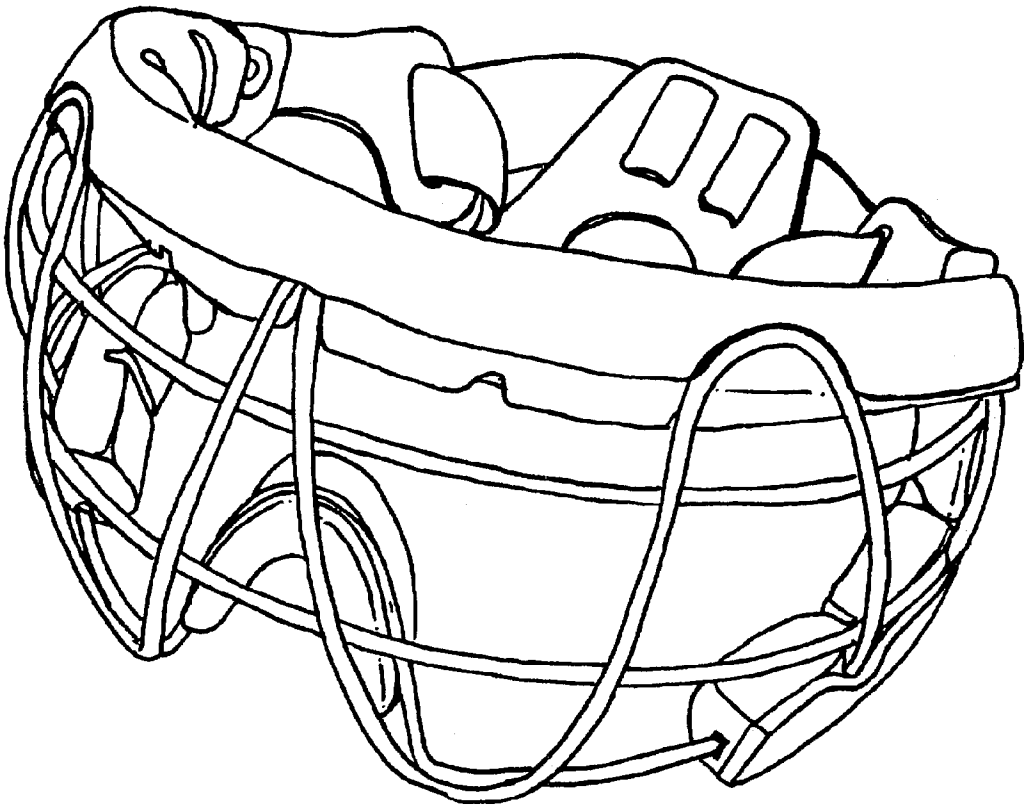
FIG. 4 shows angle view of an alternative embodiment of the protective eyewear device.
Figure 5:
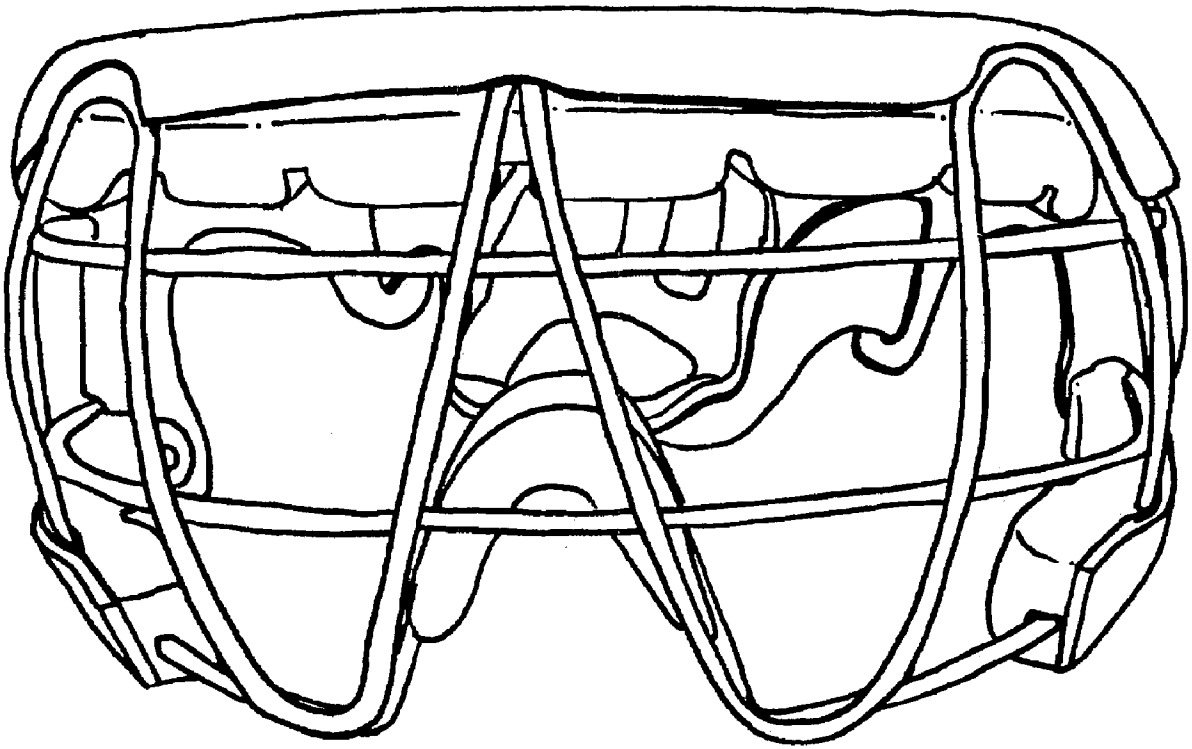
FIG. 5 shows a front view of the alternative embodiment of FIG. 4.
Figure 6:
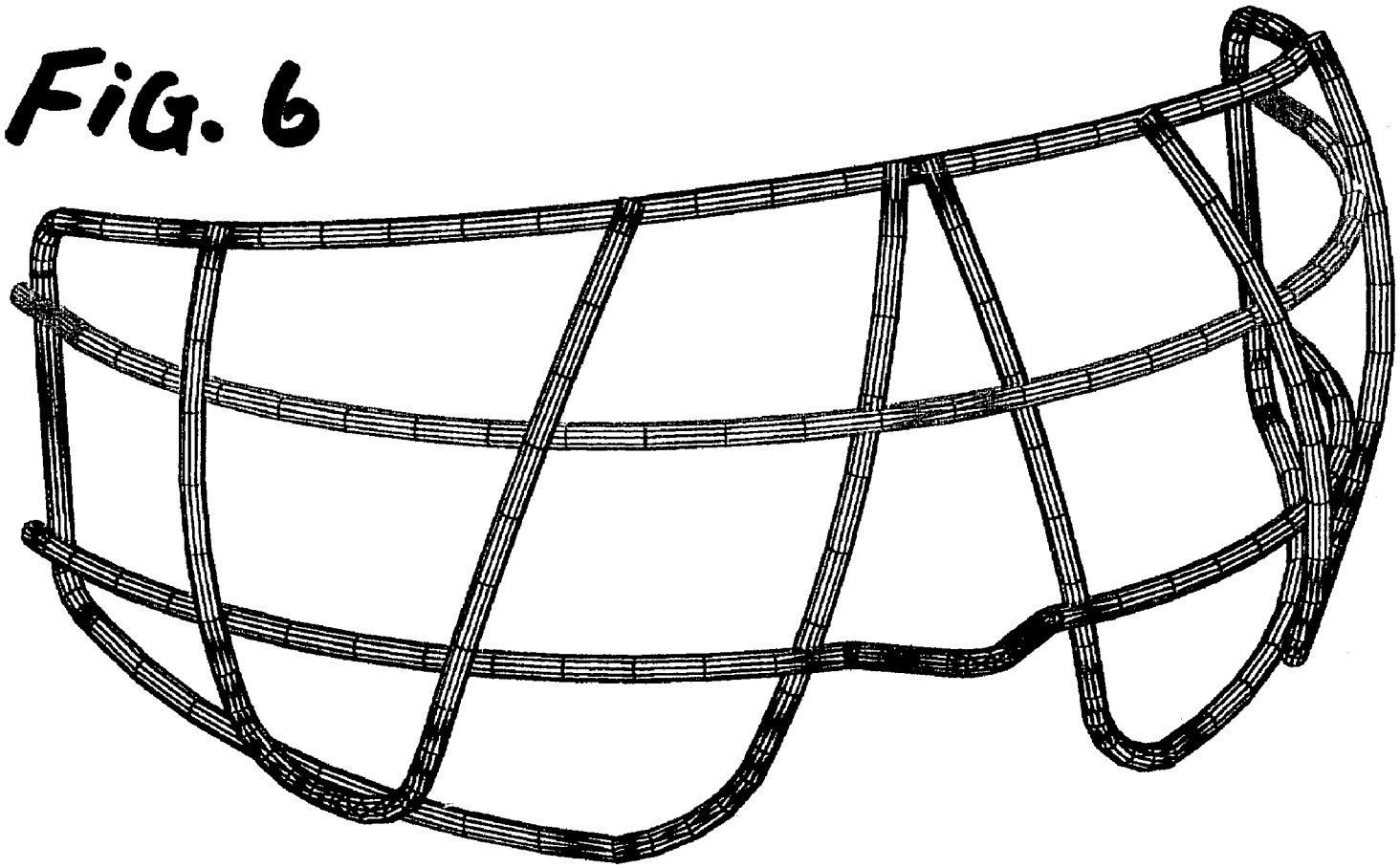
FIG. 6 shows an angle view of yet another alternative embodiment of the protective eyewear device.
Figure 7:
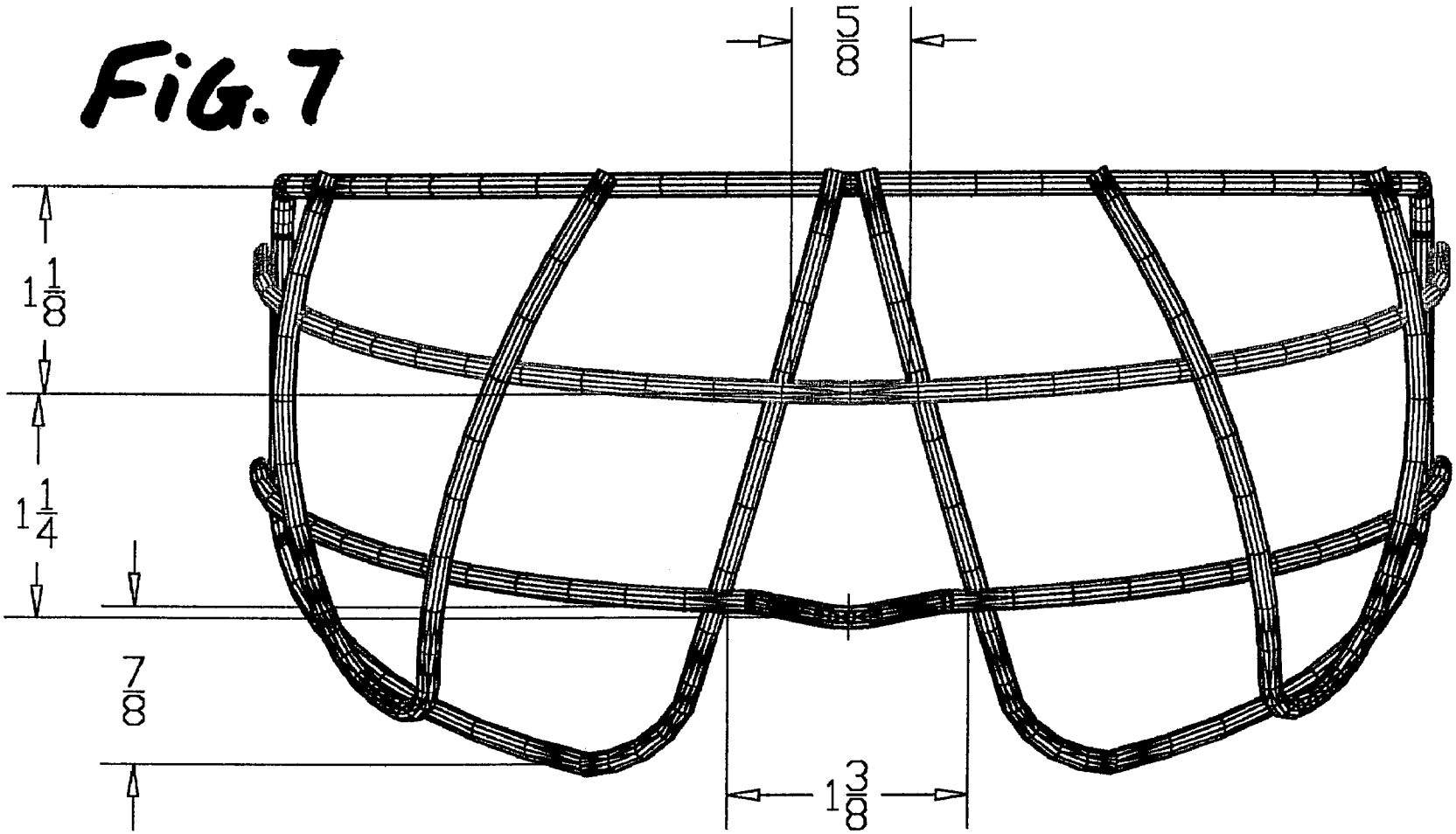
FIG. 7 shows a front view of the embodiment of FIG. 6.
Figure 8:
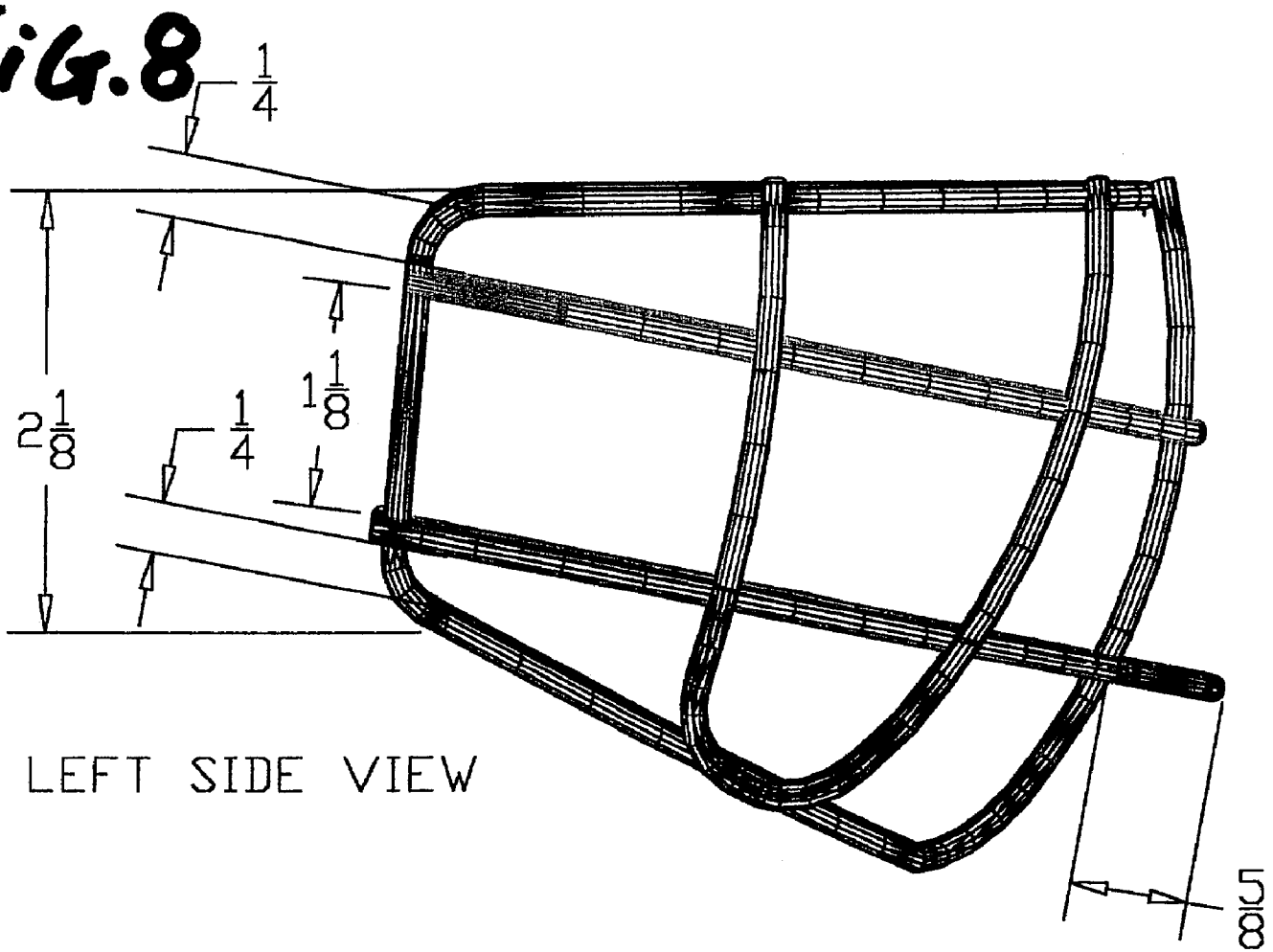
FIG. 8 shows a side view of the embodiment of FIG. 6.
Figure 9:
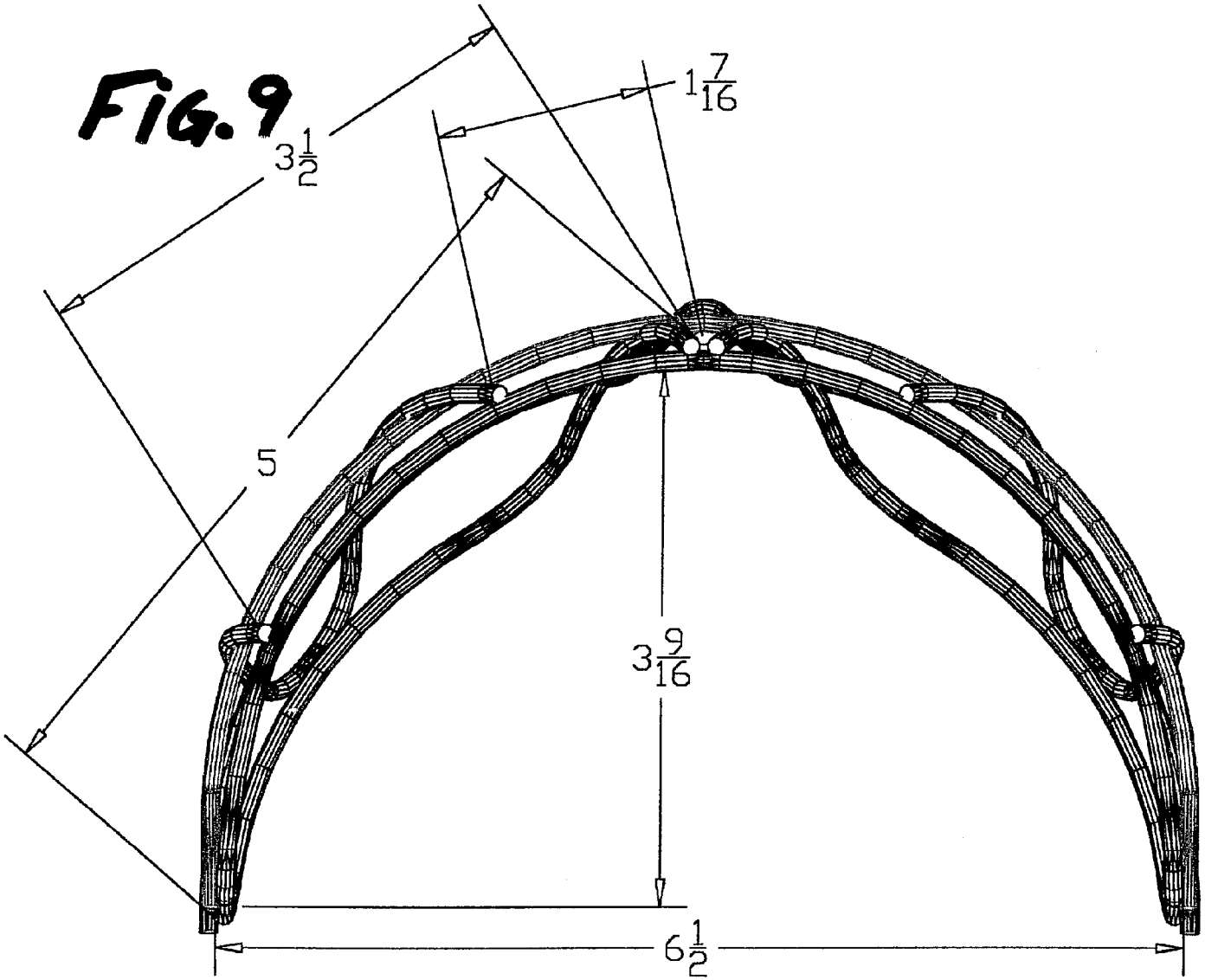
FIG. 9 shows a top view of the embodiment of FIG. 6.
Figure 10:
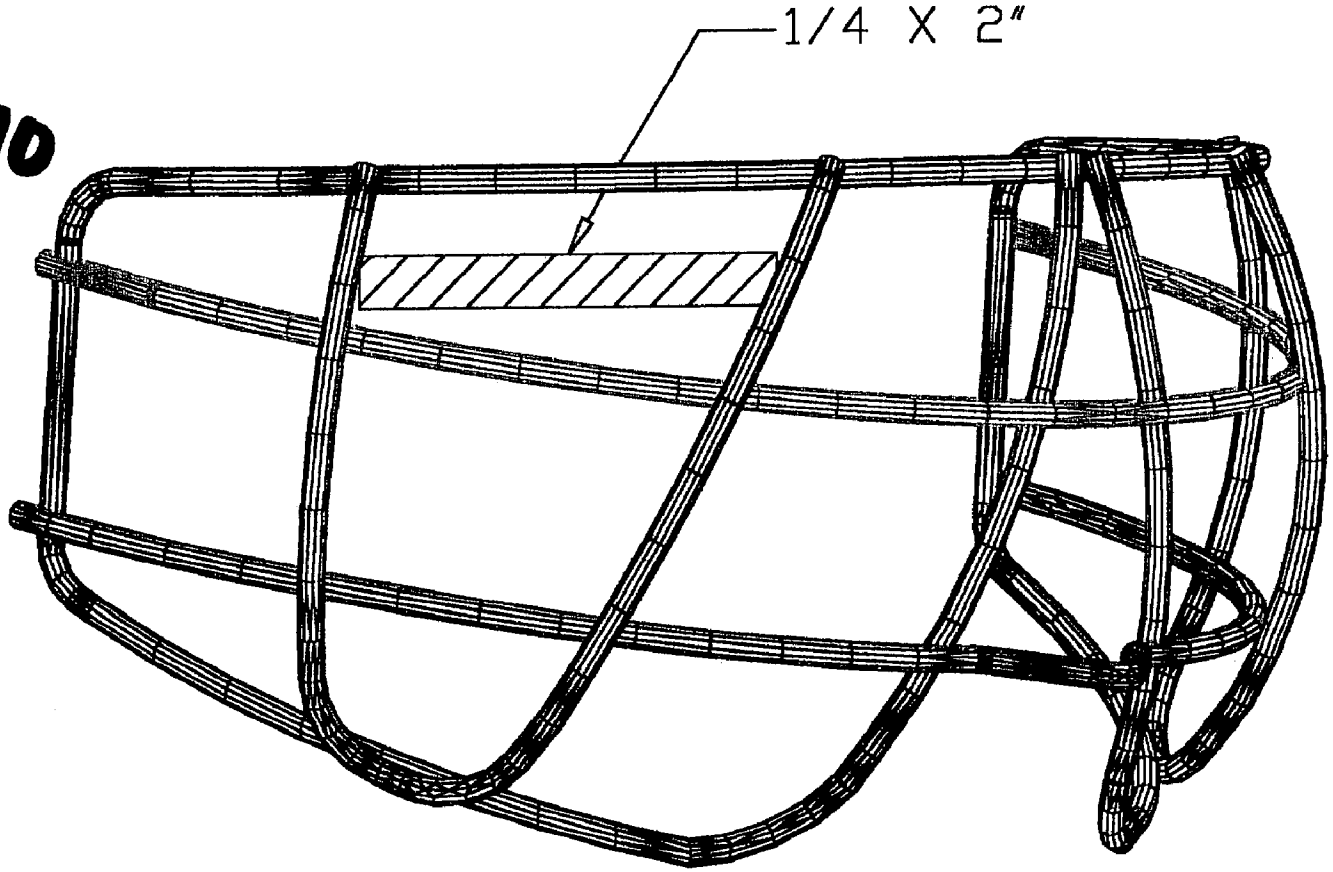
FIG. 10 shows a view of the embodiment of FIG. 6, aligned with the largest opening.
Figure 11:
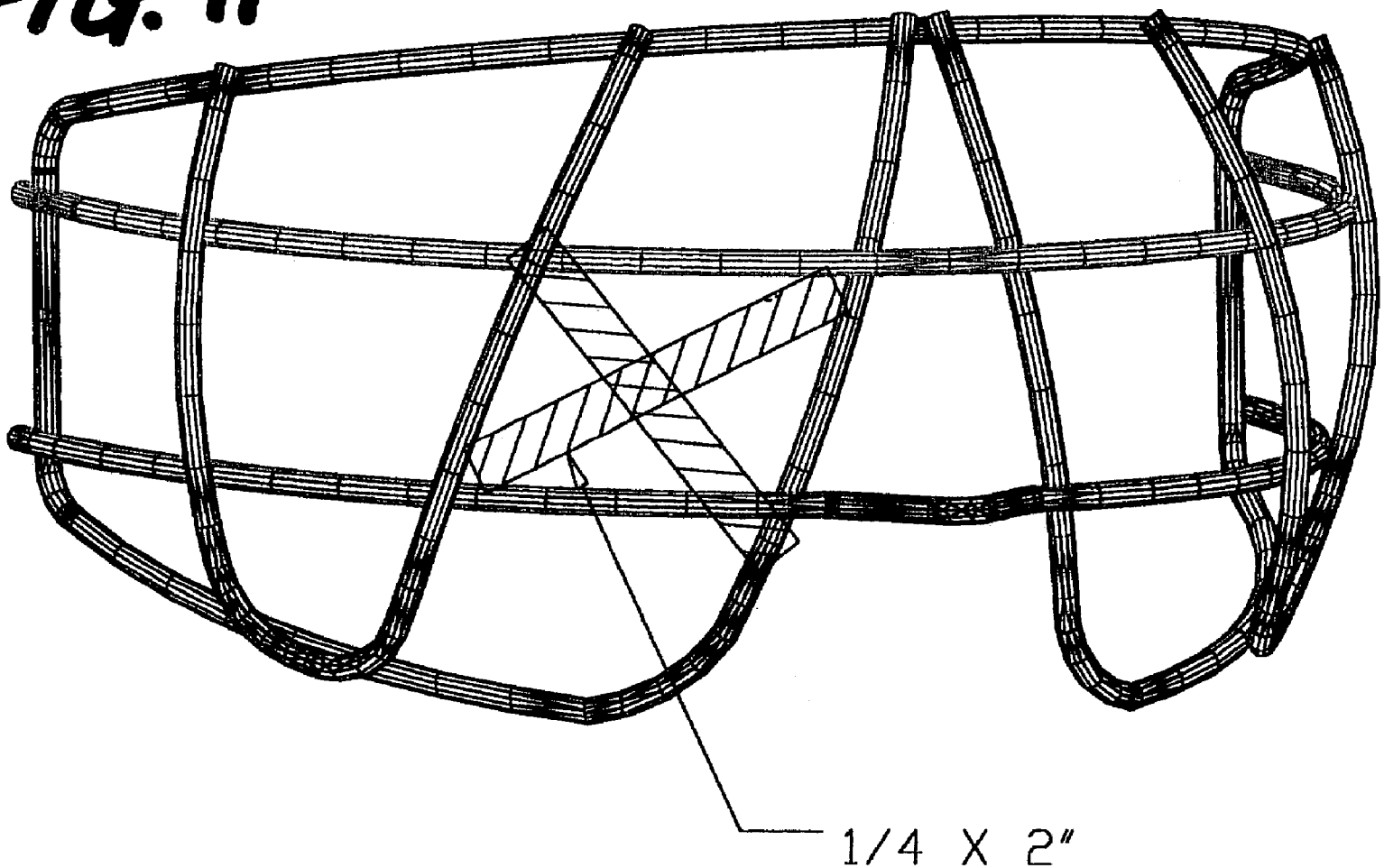
FIG. 11 shows a view of the embodiment of FIG. 6, aligned with the eye opening.

The protective eyewear of the prior art has numerous problems. For example, it is prone to glaring in the sun and fogging, particularly in cold, wet or humid weather. Further, it impedes players' vision, particularly the peripheral vision and the inferior or downward view (contributing to neck strain), and it can become scratched or marred, thereby further impairing players' vision. Furthermore, it can crack, craze or become brittle, and is susceptible to shattering upon impact, creating its own hazards. Moreover, the most common protective eyewear of the prior art does not provide ample protection against the potential impact of a lacrosse ball traveling at high-speed during play, because it is so rigid that it passes the full force of impact onto the user's face.

To address this need and the problems inherent in the prior art devices, we set out to design an improved protective eyewear device, particularly well-suited for use in women's lacrosse. The present invention provides an improved protective eyewear device for sports, addressing the problems inherent in the prior art devices. The present invention resists impacts of 60 miles per hour, and reduces the risk of injury to a player's eyes and the facial area around the eyes from contact with a ball or stick, will not fog or otherwise impede vision in cold or wet weather conditions, or cause glare in bright light conditions, and minimally impedes vision in the inferior and peripheral views. The eyewear of the present invention dissipates shock better than that of the prior art, through the spring action provided by the eye mask, which is formed as a cage. The present invention covers the facial area around the eyes, in addition to the eyes themselves. The present invention also provides improved visibility, particularly in the inferior and peripheral views. The present invention also sits better on the user's head than prior art devices, and has rounder, smoother edges than prior art devices, thus providing less corners to catch on and possibly pull the protective mask from the user's face.

In the preferred embodiment, the protective eyewear device provides an eye mask manufactured from mild spring steel wire. The parts of the wire cage work together to resist and dissipate impact, acting as a spring. The preferred embodiment meets or exceeds the ASTM standard for women's adult and youth lacrosse (ASTM standard F803-01, which is hereby incorporated herein by reference in its entirety), and can absorb and dissipate a standard lacrosse ball impact of at least sixty miles per hour.

In designing the present invention, working together with an ophthalmologist, we recorded on video tape lacrosse balls impacting the protective eyewear device, at speeds up to and in excess of sixty (60) miles per hour. These videos were reviewed frame-by-frame to analyze the effects of impact and the response of the eyewear device. Although designed primarily for women's lacrosse and field hockey applications, it is apparent that the present invention is suitable for use by both male and female players of an essentially unlimited number of indoor and outdoor sports, particularly including any activity wherein eye protection is desirable; non-sport applications of the invention are envisioned as well.

In the preferred embodiment, the eye mask is manufactured using a mild spring steel wire, which is weldable and formable. Other materials, such as metals, metal alloys, composite or synthetic materials are also suitable. Preferably, the wires are resistance welded or spot welded to hold the frame members together, to avoid the high heat of other welding methods, which could alter the spring properties of the steel. There is a trade-off in selecting the material; the greater the spring force the steel, the more difficult it is to weld and form. In one embodiment, 11 gage (or about 0.120 inches in diameter) 1018 (18% carbon) mild spring steel wire is used. Preferably, the diameter of the wire is about 0.12 to 0.15 inches; with the diameters exceeding 0.15 inches, the wire bars are visible and perceived by the human eye, which impedes vision. Thus, the optimal diameter is not more than about 4 millimeters thick.

Preferably all wire ends should overlap the railroad or perimeter wire, so that upon impact, the wire ends pull away from the face, not toward the face. Ideally, all wire ends should be located on the outer surface of the eye mask, and the wire should have a protective coating, such as rubber or a synthetic material, and should be finished so as not to present any sharp edges which could cut a player. The area of coverage preferably should be from the inferior forehead, covering both eyes (including orbit) and nasal bone, to rest on the zygomatic arch. The ears should remain free. The central field of view should be completely unobstructed. The wire layout should be such that no wire is directly in front of the pupil. The openings in the mask preferably are arranged to disallow anything that is 2 inches by ¼" inches or larger to penetrate through the mask.

Stacking of the wires has an important effect on the strength of the protective device. Preferably, the vertical frame members should be arranged on the outside surface of the horizontal members, crossing two wires at a minimum, to maximize the spring effect and minimize the chance of a wire coming loose and poking a user or another player. The eyewear device achieves strength and light weight because the parts support each other.

In regard to the contact material, the padding should cushion the eyewear to cover all hard surfaces that may come into contact with the face or eye. Any materials used should not cause skin irritation or undergo substantial physical changes as a result of contact with the face or skin. Preferably a low density foam material is used for the portion of the padding that contacts the face, such as, for example, a cross-linked polyethylene compound. Preferably, the padding comprises a dual-density open or closed cell foam as a cushion, for example, using a three (3) pound density foam (e.g., LD33) in contact with the face (for comfort), and with a six (6) pound density foam layer inside (for greater impact protection), and preferably is of the closed cell type, so that the padding does not absorb perspiration. The lower density layer is more comfortable against the face and provides softer padding, while the higher density foam on the inside provides better impact protection. Preferably the foam is located along the entire top rim and most of the outer or peripheral portion of the lower rim of the eye mask. Also, the foam optionally includes pre-formed wire-receiving recesses, so that it is lower in profile.

The means for holding the eye mask on the user's face can be any means well known in the art for securing goggles or eyeglasses to a user's face. In all cases, the retention means should cause the eyewear to remain on the athlete while active. In one embodiment, the means for securing comprises a strap of elastic material, and preferably includes an ear arch that allows the strap to be located along the center line of the eye mask, without having the strap pass over the ear. Optionally, the ear pieces hinge for easy replacement, and also allows them to be folded for display of the eye mask in a box. Optionally a rear piece anchors the straps at two locations at the rear of the skull, and can include an opening that a ponytail can go through and also allows the eye mask to be carried on a lacrosse stick.

We have found that a five-piece wire frame makes the eye mask easier to produce and lighter, and having all wire ends at the top of the mask makes trimming easier. Further, the angle of the vertical pieces preferably follows the "V" shape of the nose opening, as shown in FIG. 1, and puts an unobstructed opening directly in front of the user's pupils. Also, a constant radius of curvature makes production easier. The preferred radius of curvature is between about 3⅛ inches to 3¾ inches, and the most preferred is about 3¼ inches.

Referring now to FIG. 1, an embodiment of the protective eyewear device is shown. The eye mask has an outer frame roughly defined by substantially horizontal upper and lower frame segments, referred to as the railroad or perimeter wires. In the embodiment shown in FIG. 1, the railroad or perimeter wires actually comprise a single piece of wire, bent to form a frame with a shape similar to that of standard eyeglasses, wherein the lower frame segments bend upward to form two vertical frame members that attach at or near the center of the upper frame segment. As shown in FIGS. 1, 2, 6, 7, 10 and 11, the vertical frame members contact the upper frame segment of a tip of the inverted V-shape and an opposite end of the vertical frame members contact the lower frame segment. This embodiment also includes two additional horizontal frame members located between the upper and lower frame segments, as well as two additional vertical frame members on either side, thus defining a cage to protect the area around the user's eyes. As shown in FIGS. 1–11. an embodiment of the protective eyewear device comprises at least one substantially horizontal upper frame segment having a center, at least extending from the upper frame segment to the lower frame segment, wherein at least two of the vertical frame members are positioned at an angle from an axis extending from about the center of the upper frame segment and running perpendicular to the upper frame segment, forming a cage having an inverted V-shape which corresponds to a wearer's nose. Also shown in FIGS. 1–11, the horizontal frame member of the protective eyewear device is unobstructed by any vertical frame member along an axis from about the center of the horizontal upper frame segment and extending perpendicular to the horizontal frame member. Note that in this embodiment, the substantially vertical frame members are arranged on the outside of the substantially horizontal frame members. In another embodiment, shown in FIGS. 1–11, the upper frame segment and the lower frame segment form an outline comprising a shape that is substantially elliptical, oval, rectangular, or otherwise shaped to fit snugly to the wearer's face. The eye mask also includes a contact material for contacting the user's face area, attached to the eyewear frame, and a strap for securing the protective plastic or rubber-like material covering the ends of the mask, to which the strap is fastened, and a rear piece that anchors the strap at the rear of the user's head. The padding is attached to the mask using fasteners that wrap around the wire of the frame, as shown.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A protective eyewear device capable of protecting the eyes of a wearer, comprising:

at least one substantially horizontal upper frame segment having a center;

at least one substantially horizontal lower frame segment; and at least two substantially vertical frame members extending from the upper frame segment to the lower frame segment, wherein at least two of the vertical frame members are positioned at an angle from an axis extending from about the center of the upper frame segment and running perpendicular to the upper frame segment, forming a cage having an inverted V-shape which corresponds to a wearer's nose, wherein the vertical frame members contact the upper frame segment at a tip of the inverted V-shape and an opposite end of the vertical frame members contact the lower frame segment.

2. The protective eyewear device of claim 1, further comprising a horizontal frame member contacting at least two of the vertical frame members.

3. The protective eyewear device of claim 2, wherein the horizontal frame member is unobstructed by any vertical frame member along an axis from about the center of the horizontal upper frame segment and extending perpendicular to the horizontal frame member.

4. The protective eyewear of claim 1, wherein the upper frame segment, the lower frame segment and at least two substantially vertical frame members comprise a wire material.

5. The protective eyewear of claim 4, wherein the wire material comprises a metal, metal alloy, composite or synthetic material.

6. The protective eyewear of claim 5, wherein the metal or metal alloy composition comprises 1018 spring steel wire.

7. The protective eyewear of claim 5, wherein the wire material has a thickness of from about 0.12 inches to 0.15 inches.

8. The protective eyewear of claim 5, wherein the wire material has a thickness of under 4 millimeters.

9. The protective eyewear of claim 1, wherein the substantially vertical frame members are rigidly attached to the upper frame segment and the lower frame segment by welding.

10. The protective eyewear of claim 1, wherein the protective eyewear can absorb a lacrosse ball impact of at least sixty miles per hour.

11. The protective eyewear of claim 1, wherein the upper frame segment and the lower frame segment form an outline, the outline comprising a shape that is substantially elliptical, oval, rectangular, or otherwise shaped to fit snugly to the wearer's face.

12. The protective eyewear of claim 1, further comprising means for securing the eyewear device to the wearer.

13. The protective eyewear of claim 12, wherein the means for securing the eyewear device comprises an elastic material.

14. The protective eyewear of claim 1, wherein the eyewear device further comprises a padding material for contacting the wearer's face.

15. The protective eyewear of claim 14, wherein the padding material comprises closed-cell foam.

16. A protective eyewear device capable of protecting the eyes and nose of a wearer, comprising:

at least one substantially horizontal upper frame segment having a center;

at least one substantially horizontal lower frame segment; and at least two substantially vertical frame members extending from the upper frame segment to the lower frame segment, wherein at least two of the vertical frame members are positioned at an angle from an axis extending from about the center of the upper frame segment and running perpendicular to the upper frame segment, forming a cage having an inverted V-shape which corresponds to a wearer's nose, further comprising at least two horizontal frame members, each contacting at least two of the vertical frame members forming an opening, the opening sized to restrict an object having a first dimension of two inches and a second dimension of ¼ inches from passing through the opening.

17. The protective eyewear device of claim 16, further comprising:

at least one horizontal frame member extending from a first vertical frame member to a second vertical frame member, wherein the horizontal frame member extends substantially outward from the upper frame segment and corresponds to the nose of the wearer.

18. The protective eyewear device of claim 17, wherein the at least one horizontal frame member is unobstructed by any vertical frame member along an axis extending from about the center of the horizontal upper frame segment and running perpendicular to the horizontal frame member.

19. The protective eyewear of claim 17, wherein the upper frame segment, the lower frame segment and at least two substantially vertical frame members comprise a wire material.

20. The protective eyewear of claim 19, wherein the wire material comprises a metal, metal alloy composition, composite or synthetic composition.

21. The protective eyewear of claim 19, wherein the wire material has a thickness of from about 0.12 inches to 0.15 inches.

22. The protective eyewear of claim 17, wherein the upper frame segment and the lower frame segment form an outline, the outline comprising a shape that is substantially elliptical, oval, rectangular, or otherwise shaped to fit snugly to the wearer's face.

23. The protective eyewear of claim 17, further comprising means for securing the eyewear device to the wearer.

24. A protective eyewear device for use without a helmet, comprising:

at least one substantially horizontal upper frame segment;

at least one substantially horizontal lower frame segment; and a plurality of vertical frame members extending from the horizontal upper frame segment to the horizontal lower frame segment, wherein the vertical frame members have a radius of curvature of from about 3⅛ inch to about 3¼ inch, and wherein at least two of the vertical frame members are positioned at an angle from an axis extending from a center of the upper frame segment and running perpendicular to the horizontal frame segment, forming a cage having an inverted V-shape which corresponds to a wearer's nose, the vertical frame members contacting the upper frame segment at a tip of the inverted V-shape and an opposite end of the vertical frame members contact the lower frame segment.

25. The protective eyewear device of claim 24, further comprising a horizontal frame member contacting at least two of the vertical frame members.

26. The protective eyewear device of claim 24, further comprising at least one horizontal frame member extending between at least two vertical frame members, wherein the horizontal frame member extends substantially outward from the upper frame segment and corresponding to a wearer's nose.

27. The protective eyewear device of claim 24, wherein the upper frame segment, the lower frame segment and at least two substantially vertical frame members comprise a wire material.

28. A protective eyewear device for use without a helmet, comprising:

at least one substantially horizontal upper frame segment;

at least one substantially horizontal lower frame segment; and a plurality of vertical frame members extending from the horizontal upper frame segment to the horizontal lower frame segment, wherein the vertical frame members have a radius of curvature of from about 3⅛ inch to about 3¼ inch, further comprising at least two horizontal frame members, each contacting at least two vertical frame members forming an opening, the opening sized to restrict an object having a first dimension of two inches and a second dimension of ¼ inches from passing through the opening.

* * * * *